US005378166A

United States Patent [19]

Gallagher, Sr.

[11] Patent Number: 5,378,166

[45] Date of Patent: Jan. 3, 1995

[54] CASE AND CABLE ASSEMBLY

[75] Inventor: Robert E. Gallagher, Sr., Harrisburg, Pa.

[73] Assignee: The Whitaker Corporation, Wilmington, Del.

[21] Appl. No.: 120,997

[22] Filed: Sep. 13, 1993

[51] Int. Cl.[6] ..... H01R 13/518

[52] U.S. Cl. ..... 439/214; 439/501; 439/540

[58] Field of Search ..... 439/214, 215, 501, 540, 439/207, 211, 216, 638, 701; 174/92, 38

[56] References Cited

U.S. PATENT DOCUMENTS

| | | | |
|---|---|---|---|
| 3,283,059 | 11/1966 | Plummer | 174/38 |
| 3,445,585 | 5/1969 | Meisel et al. | 174/59 |
| 3,466,380 | 9/1969 | Baumgartner et al. | 174/38 |
| 3,604,835 | 9/1971 | Hamilton | 174/38 |
| 3,610,810 | 10/1971 | Fribley, Jr. | 174/59 |
| 3,701,835 | 10/1972 | Eisele | 174/41 |
| 3,769,443 | 10/1973 | Pierzchala et al. | 174/38 |
| 3,784,728 | 1/1974 | De Bortoli et al. | 174/60 |
| 3,904,936 | 9/1975 | Hamrick, Jr. et al. | 174/60 |
| 4,243,834 | 1/1981 | Logioco | 174/38 |
| 4,371,757 | 2/1983 | Debortoli et al. | 174/38 |
| 4,403,106 | 9/1983 | Lask et al. | 174/59 |
| 4,647,715 | 3/1987 | Butler | 174/41 |
| 4,666,240 | 5/1987 | Caron et al. | 350/96.20 |
| 4,749,359 | 6/1988 | White | 439/133 |
| 4,950,168 | 8/1990 | Watanabe et al. | 439/540 |
| 4,952,168 | 8/1990 | Schieferly et al. | 439/467 |
| 5,049,703 | 9/1991 | Simon | 174/52.1 |
| 5,111,001 | 5/1992 | Jervis | 174/92 |

*Primary Examiner*—Gary F. Paumen

[57] ABSTRACT

The present invention includes a case containing a cable assembly therein for installation in electrical equipment. The case is secured to the frame of the equipment and holds the individual cables and positions the ends thereof for interconnection with electrical components in the equipment. The case includes openings in a side through which the cable ends protrude. The cables are attached to a floor of the case by means of double-backed tape. A cover is included to completely enclose the cable assembly within the interior of the case to protect the cable assembly from possible damage by adjacent equipment.

18 Claims, 3 Drawing Sheets

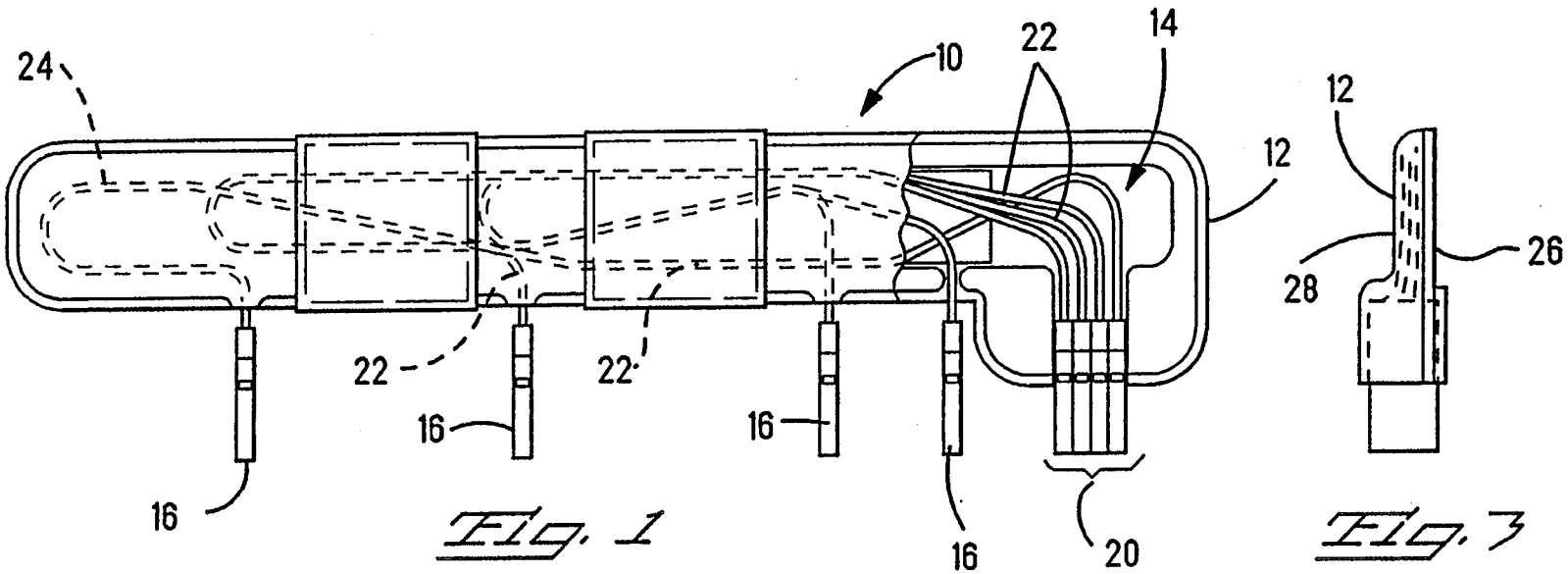
FIG. 1
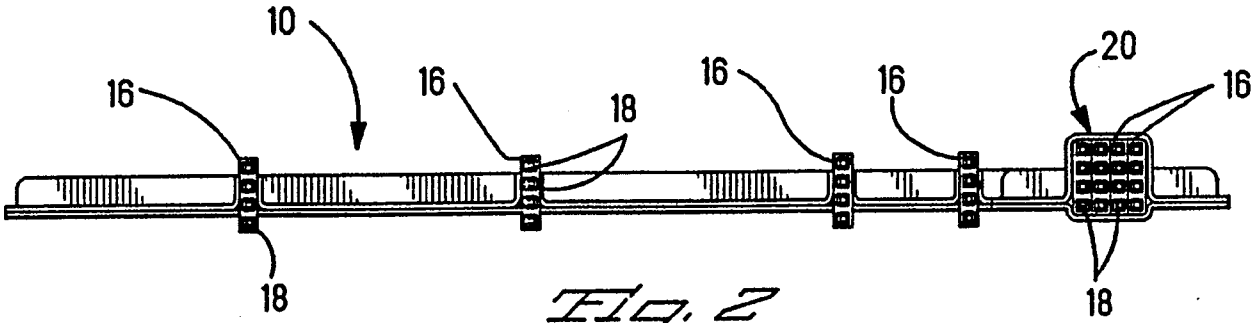
FIG. 2
FIG. 3

CASE AND CABLE ASSEMBLY

The present invention relates to cable assemblies and cases for enclosure thereof to protect the individual cables from damage and to position the ends of the cables for interconnection with other electrical components.

BACKGROUND OF THE INVENTION

Electrical cable assemblies and wiring harnesses, when installed in electrical equipment, are typically routed along and secured to convenient frame members of the equipment by ties or other attaching means to keep the individual wires and cables neatly organized and away from adjacent equipment to prevent possible damage. Plastic or rubber grommets are used at bulkheads and where abrasive wear may occur. Such methods will occasionally result in a cable being bent around too small of a radius or being kinked because a tie is too tight. Ordinarily this causes no problem with commonplace electrical circuits. However, when dealing with high speed signals, such as clocking or timing pulses for high speed computers, such tight bends or kinking may have an adverse effect on the signal. Often times cables carrying such signals must be of a specific length so that the signal is propagated within a desired time interval. This frequently results in some cables having excess length that must be carefully arranged and secured to the frame thereby adding to the problem. What is needed is a case that will hold and position the individual cables of a cable assembly for convenient interconnection with electrical equipment and that will physically protect the cable from damage by adjacent equipment. The case will be secured to the frame member, thereby eliminating the chance of kinking creating a tight bend.

SUMMARY OF THE INVENTION

A case is provided in combination with a cable assembly of the type having a plurality of individual cables each of which is a precise desired length. The ends of each cable are positioned for interconnection with other electrical components. The case includes a body of elongated shape having a floor substantially surrounded by a sidewall thereby defining an interior cavity. The sidewall has openings for receiving the ends of each cable and positioning the ends on the desired spacing. A removable cover is arranged to engage the body and substantially enclose the interior cavity. The ends of the cable extend through their respective openings and the remainder of the cable is disposed within the interior cavity.

DESCRIPTION OF THE FIGURES

FIG. 1 is a plan view of the case and cable assembly incorporating the teachings of the present invention;

FIG. 2 is a front view of the case assembly shown in FIG. 1;

FIG. 3 is an end view of the case assembly shown in FIG. 1;

FIG. 5 is a plan view of the case shown in. FIG. 1, in its open position;

FIG. 6 is a front view of the case shown in FIG. 5; and

FIG. 7 is a back view of the case shown in FIG. 5.

DESCRIPTION OF THE PREFERRED EMBODIMENT

There is shown in FIGS. 1, 2, and 3 an assembly 10 including a case 12 and a cable assembly 14 contained therein.

Figure 4:
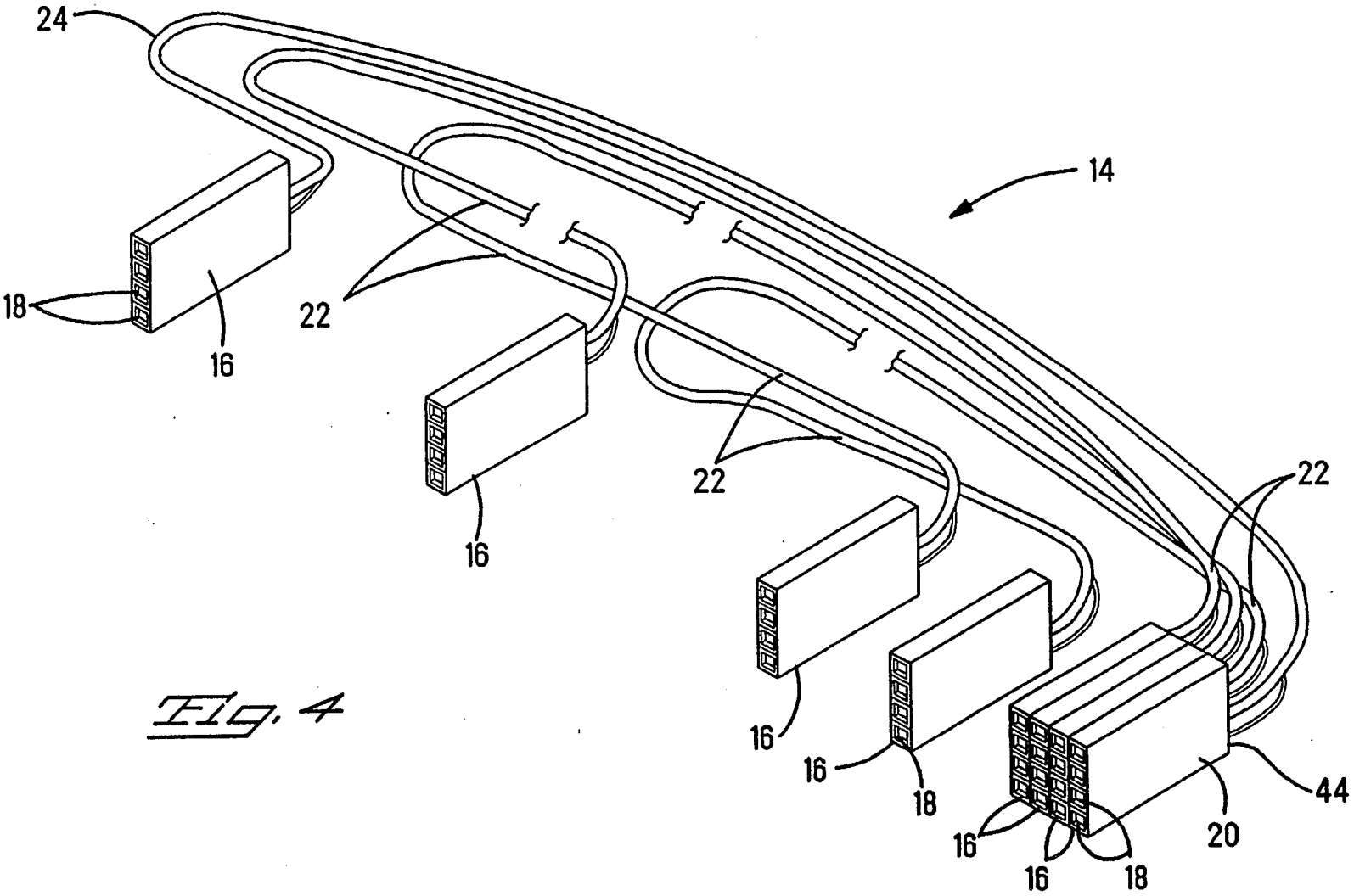
FIG. 4 is an isometric view of the cable assembly shown in FIG. 1.

As best seen in FIG. 4, the cable assembly 14 includes a first group of four individual four-position connectors 16, each having four receptacle contacts 18, and a second group of four four-position connectors 16 arranged in an array 20. The four four-position connectors that form the array 20 are attached to each other by means of a suitable adhesive such as LOCTITE manufactured by LOCTITE Corporation. The cable assembly includes four coaxial cables 22 having one end of each being terminated to a pair of contacts 18 of each of the connectors 16 in the first group of connectors and the other end of each being terminated to a pair of contacts 18 of each connector of the array 20 in the second group. This arrangement can accommodate up to eight coaxial cables, however, any desired number of cables may be accommodated by simply changing the connector configuration. The signals carried by the cables 22 are high speed timing pulses that originate in control equipment that interconnects to the contacts 18 of the connector array 20 and is distributed to other equipment via the connectors 16. The equipment being controlled, in the present example, is various portions of a computer requiring very precise timing. Since the timing of the signal pulses is critical, their propagation time through the cable assembly 14 must be controlled. This is accomplished by cutting each cable 22 to a precise desired length, in the present example all of the cables 22 are of identical length. The length of each cable is substantially greater than the distance between its respective contact 18 in the connector array 20 and the corresponding contact in the connector 16 at the other end, resulting in considerable slack cable that must be looped, as at 24 in FIG. 4. Care must be taken to assure that any loops or bends in the cables 22 have a minimum radius of about three times the diameter of the cable and that there are no sharp bends or kinks that would adversely affect the signal.

Figures 5, 6, 7:
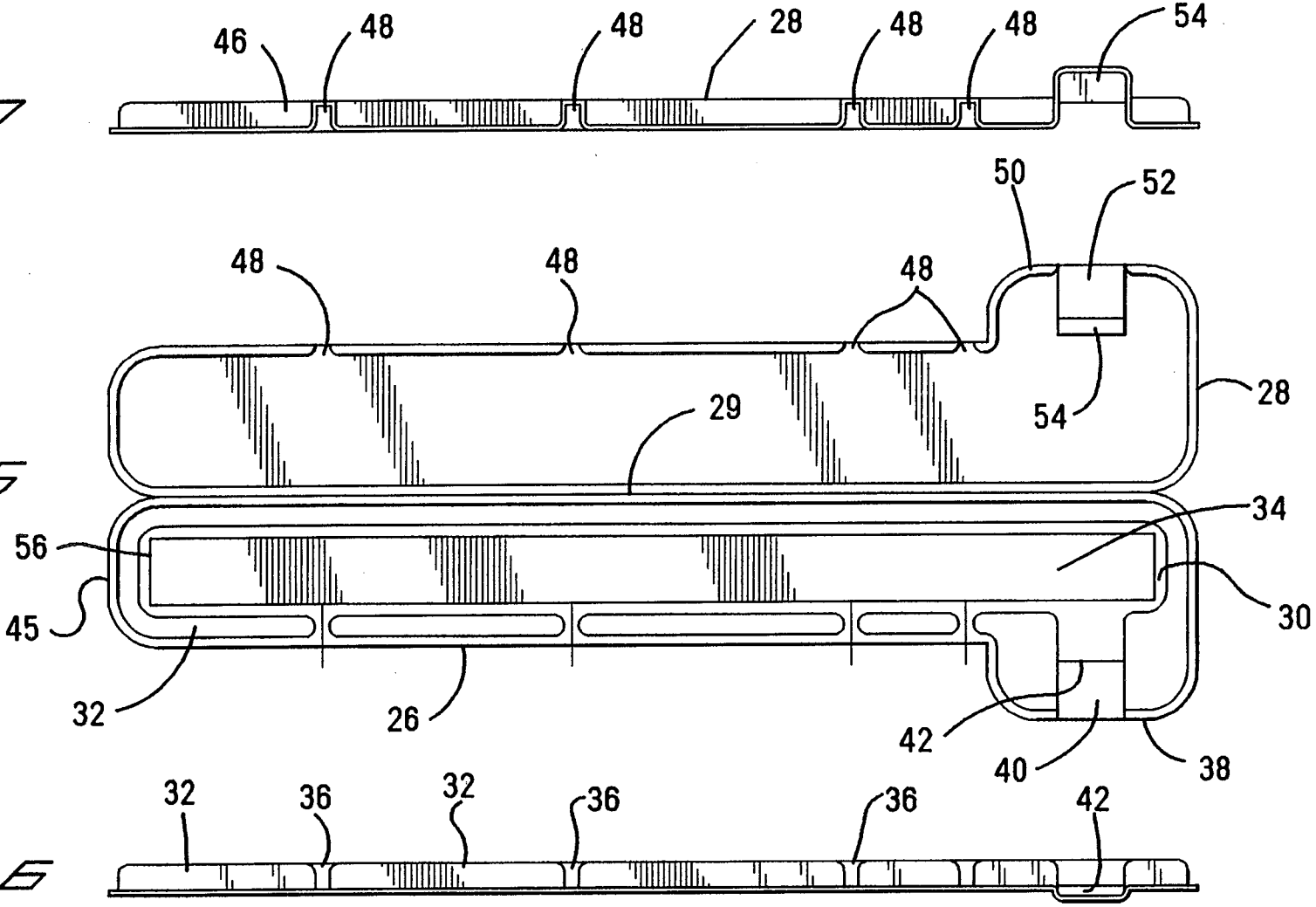

As best seen in FIGS. 5, 6, and 7 the case 12 includes a body 26 and a lid 28 which may be hingedly attached to the body along the common edge 29, however, in the present example, the lid and body are separate pieces. The body 26 is of elongated shape having a floor 30 and a raised wall 32 surrounding the floor thereby defining an interior cavity 34. The cables 22 are disposed within this cavity except for the cable ends terminated to contacts in the connectors 16. There are four openings 36 in the wall 32 large enough to receive and pass through these cable ends so that the connectors 16 will be completely outside of the case 12. Each opening 36 must be large enough to accommodate the number of cable ends terminated to the connector 16, one such cable end to each connector in the present example. One end of the body 26 includes a projection 38 having an opening 40 for receiving the connector array 20. The width of the opening 40 is just slightly larger than the width of the array 20 to proved a snug fit. The floor of the opening 40 is below the level of the floor 30 thereby providing a shoulder 42 at the back of the opening. A rear lower edge 44 of the connector array 20 is in abutting engagement with this shoulder 42, for a purpose that will be explained. A lip 45 extends around the periphery of the body 26 except past the opening 40. The lid 28 has the general elongated shape of the body 26 and includes a wall 46 disposed around its periphery. The wall 46 has four openings 48 therethrough in registry with the openings 36 of the body 26. The lid 28 includes a projection 50 that conforms in shape to the projection 38 and has an opening 52 that is opposite to, in alignment with, and of the same width as the opening 40, when the lid and body are assembled. The opening 52 terminates in a back wall 54 that is beveled to provide clearance for the cables 22 that are terminated to the connector array 20. The wall 46 is positioned so that its interior surface snugly engages the outer surface of the wall 32 thereby providing a slight interference fit between the two parts. The outer surface of the wall 46 is flush with the outer edge of the lip 44. A strip of adhesive material 56, show in FIG. 5 in phantom lines, is disposed on the floor 30 of the body 26 for holding the cables 22 in place. In the present example double backed tape was used, however, any suitable adhesive may be advantageously used. The lid 28 and body 26, in the present example, are made of any suitable plastic material, however, other suitable materials such as metal may be used.

When assembling the cable assembly 14 to the case 12 the connector array 20 is secured to the body 26 within the opening 40 by means of any suitable adhesive such as the above mentioned LOCTITE. The cables 22 are then distributed along the floor 30 of the body 26 and pressed against the adhesive strip 56 so that they are held in place by the adhesive. Any slack or excess cable is carefully looped around to avoid kinks and sharp bends. The LOCTITE is then applied to two or three places along portions of the wall 32 that will engage the lid 28, and the lid carefully aligned to the body 26 and pressed in place. The LOCTITE is allowed to cure and then the case and cable assembly is ready for installation onto the backplane of an equipment rack or any other desired equipment. To achieve repairability, the LOCTITE bond must be able to be easily broken by prying the lid 28 off of the body 26. This must be considered when selecting an adhesive for holding the lid 28 to the body 26. When installing the assembly 10, the connector array 20 is first mated with its mating connector, not shown, by simply pushing the case 12 so that the force is transmitted to the connector array through the shoulder 42. The other connectors 16 are loosely positioned by their cable ends being guided by the openings 36,48 and are somewhat free to be manipulated by hand into mating engagement with their respective mating connectors. With all connectors properly mated the case 12 is then attached to a frame member, not shown, by any suitable means.

While the present example discloses a cable assembly of coaxial cables carrying high speed timing pulses, the teachings of the present invention may be advantageously utilized in applications of other types of cables and wiring harnesses where it is desirable to prevent kinking and tight bends of the individual cables or wires. Additionally, similar connectors are shown at both ends of the cables 22,.but it will be understood that any configuration or combination of different connectors may be utilized in the practice of the present invention including individual connectors in place of the array 20, and cable ends extending through any of the openings without connectors terminated thereto.

An important advantage of the present invention is that the individual cables are not tied to the equipment frame and so cannot be subjected to sharp bends or kinking during installation. The case positions the terminated ends of the cables for convenient mating to their respective mating connectors and completely encloses the cables and protects them from possible damage by adjacent equipment. The cost to manufacture the case 12, assemble the cables therein, and install the assembly into the equipment is less than the alternative and provides the additional benefit of increased reliability of the operating equipment.

I claim:

1. A case in combination with a cable assembly of the type having a plurality of individual cables each of which is a precise desired length, wherein the ends of each said cable are positioned by said case for interconnection with other electrical components outside of said case, said case comprising:

(a) a body of elongated shape having a floor substantially surrounded by a sidewall thereby defining an interior cavity, said sidewall having openings for receiving respective said ends of each said cable and positioning said ends on a desired spacing; and (b) a removable cover arranged to engage said body and substantially enclose said interior cavity, wherein said ends of said cable extend through their respective openings and the remainder of said cable is disposed within said interior cavity.

2. The combination according to claim 1 wherein said ends of at least one of said cables are positioned on a spacing that is substantially less than said precise length of said cable and said remainder of said cable is arranged along said floor of said interior cavity in a relatively smooth and continuous path.

3. The combination according to claim 1 wherein said cover has a shape that conforms to said elongated shape of said body and has a sidewall that engages the outer periphery of said sidewall of said body.

4. The combination according to claim 1 wherein said cover is hingedly attached to said body along mutually adjacent edges thereof.

5. The combination according to claim 3 wherein said sidewall of said cover substantially surrounds said sidewall of said body, and includes openings in alignment with said openings in said sidewall of said body.

6. The combination according to claim 1 wherein said ends of some of said cables are terminated to respective electrical connectors, some of which are disposed substantially outside of said case.

7. The combination according to claim 1 wherein said ends of some of said cables are terminated to respective electrical connectors, some of which are disposed at least partially within said case.

8. The combination according to claim 7 wherein said electrical connectors comprise a plurality of individual electrical connectors arranged together to form a connector array, and wherein said connector array is attached to said case within one of said openings.

9. The combination according to claim 8 wherein said connector array is a square array having a similar number of connector contacts on each side, one end of each said cable being terminated to a respective connector contact of said square array and the other ends of said cables terminated to a contact of a respective one connector having said similar number of contacts.

10. The combination according to claim 8 wherein said array of connectors includes four four-position connectors stacked side by side to form a four by four connector array.

11. The combination according to claim 1 including attachment means for attaching said remainder of said cable to said floor of said body.

12. The combination according to claim 11 wherein said attachment means includes double-backed tape in adhesive contact with said floor.

13. A case arranged to hold and position a cable assembly of the type having a plurality of individual cables each of which is a precise desired length, wherein the ends of each said cable are positioned by said case for interconnection with other electrical components, said case comprising:

(a) a body of elongated shape having a floor substantially surrounded by a sidewall thereby defining an interior cavity, said sidewall having openings adapted for receiving said ends of each said cable and positioning said ends on a desired spacing; and (b) a removable cover arranged to engage said body and substantially enclose said interior cavity, wherein said interior cavity is adapted to contain a portion of each of said cables, a projection having an opening arranged to receive and position an array of connectors, and said cable assembly comprising said array of connectors received and positioned by said opening, said connectors being terminated to ends of at least one of said cables.

14. The case according to claim 13 wherein said cover has a shape that conforms to said elongated shape of said body and has a sidewall that engages the outer periphery of said sidewall of said body.

15. The case according to claim 14 wherein said sidewall of said cover substantially surrounds said sidewall of said body, and includes openings in alignment with said openings in said sidewall of said body.

16. The case according to claim 13 wherein said cover is hingedly attached to said body along mutually adjacent edges thereof.

17. The case according to claim 13 including attachment means adapted for attaching a portion of said cable to said floor of said body.

18. The case according to claim 17 wherein said attachment means includes double-backed tape in adhesive contact with said floor.

* * * * *